United States Patent [19]

Niitsuma et al.

[11] Patent Number: 5,048,387

[45] Date of Patent: Sep. 17, 1991

[54] HORIZONTAL PERFORATION FORMING APPARATUS FOR ROTARY PRESS

[75] Inventors: Tsutomu Niitsuma; Shin Ohsawa, both of Ibaraki, Japan

[73] Assignee: Komori Corporation, Tokyo, Japan

[21] Appl. No.: 484,065

[22] Filed: Feb. 23, 1990

[30] Foreign Application Priority Data

Jul. 14, 1989 [JP] Japan ..... 1-180600

[51] Int. Cl.[5] ..... B26D 1/62

[52] U.S. Cl. ..... 83/344; 83/507; 83/674; 83/508.2

[58] Field of Search ..... 83/344, 503, 343, 346, 83/339, 660, 674 X, 506, 507 X, 561, 508.2 X

[56] References Cited

U.S. PATENT DOCUMENTS

| | | | |
|---|---|---|---|
| 3,283,633 | 11/1966 | Finke et al. | 83/344 X |
| 3,590,695 | 7/1971 | Gerard | 83/660 X |
| 3,691,810 | 9/1972 | Tadeusz | 83/344 X |
| 4,063,493 | 12/1977 | McEvers et al. | 83/561 X |
| 4,090,701 | 5/1978 | Von Heim | 83/344 X |
| 4,450,740 | 5/1984 | Chapman, Jr. et al. | 83/344 X |
| 4,674,377 | 6/1987 | Groth | 83/561 X |
| 4,922,779 | 5/1990 | Fritz et al. | 83/503 |

*Primary Examiner*—Mark Rosenbaum
*Assistant Examiner*—Kenneth E. Peterson
*Attorney, Agent, or Firm*—Remy J. VanOphem

[57] ABSTRACT

A horizontal perforation forming apparatus for a rotary press includes an interaxial distance adjusting unit for adjusting a distance between axes of perforation and mating cylinders. The apparatus also includes a phase adjusting unit having a phase adjusting shaft which is axially moved to pivot the perforation cylinder. The phase adjusting shaft is moved upon pivotal movement of an operation shaft of the interaxial distance adjusting unit.

10 Claims, 15 Drawing Sheets

HORIZONTAL PERFORATION FORMING APPARATUS FOR ROTARY PRESS

BACKGROUND OF THE INVENTION

The present invention relates to a horizontal perforation forming apparatus attached to a folder of a web rotary press to form horizontal perforations extending in a widthwise direction of a traveling web.

A folder is attached to a web rotary press to fold a printed web in its widthwise or longitudinal direction. A horizontal perforation forming apparatus is arranged in the folder to form horizontal perforations extending in the widthwise direction of the web in a perspective folding portion so as to facilitate a subsequent folding operation.

FIG. 16 is a schematic side view of a conventional horizontal perforation forming apparatus of this type. This apparatus will be described with reference to FIG. 16. A horizontal perforation forming apparatus 2, upper and lower nipping rollers 3 and 4, and a rubber roller 5 and a press roller 6 which are respectively in rolling contact with the nipping rollers 3 and 4 are arranged in the traveling path of a web 1 which is traveling between a former (not shown) for folding the printed web in the widthwise direction and a folding cylinder (not shown) for folding the printed web in the longitudinal direction. In the horizontal perforation forming apparatus 2, a perforation cylinder 7 and its mating cylinder 8 are spaced apart from each other by a small gap. A perforation blade case 14 is fixed in a perforation blade groove 7*a* formed in the axial direction of the perforation cylinder 7. The perforation blade case 14 includes a perforation blade base 9 having a length corresponding to a generator of the perforation cylinder 7, a press plate 10 and a shim 11 which surround the perforation blade base 9, a paper holder 12 dovetailed with the perforation blade base 9, and an elongated plate-like perforation blade 13 held by the central perforation blade groove. The distal end of the perforation blade 13 extends outward from the paper holder 12. An elongated perforation blade seat 15 is fixed in a perforation blade receiving groove 8*a* extending in the axial direction of the mating cylinder 8. The cylinders 7 and 8, the nipping rollers 3 and 4, and the like are driven from folding paper cylinders through gears in directions indicated by arrows.

With the above structure, the web 1 conveyed upon printing is fed out by the upper nipping roller 3 and is guided to a gap between the cylinders 7 and 8. When the web 1 has passed between the cylinders 7 and 8, it is guided to the lower nipping roller 4 by the folding paper cylinders. In this case, during passing of the web 1 between the cylinders 7 and 8, horizontal perforations are formed in the web 1 by the perforation blade 13 every predetermined interval corresponding to the circumferential length of the cylinder 7 or 8, i.e., every perspective folding position.

In this horizontal perforation forming apparatus, if a gap between the paper holder 12 and the perforation blade seat 15 is not appropriate when they oppose each other, perforations are excessively formed and the web is torn during folding. Alternatively, when perforations are not satisfactory, predetermined folding precision cannot be assured. Therefore, this gap between the paper holder 12 and the perforation blade seat 15 must be appropriately determined. In a conventional perforation forming apparatus, when the distal end of the perforation blade 13 is worn and an extension amount from the paper holder 12 is reduced, when the thickness of printed matters is changed, or when the strength of the perforation portion is changed due to influences of printing conditions (e.g., printing dampening water, an ink, and an image pattern), a drying temperature, an ambient temperature, and paper quality, the perforation blade case 14 as a whole must be removed, and the shim 11 is replaced with a new one or the extension amount of the perforation blade 13 is adjusted. In addition, when printing matters are changed to ones without requiring horizontal perforations, the perforation blade case 14 as a whole is removed, and a balance weight is mounted in place of the perforation blade case 14 so as to prevent unbalance.

In this conventional horizontal perforation forming apparatus described above, the extension amount of the perforation blade 13 must be adjusted. In addition, every time the printed matters are changed to ones which do not require horizontal perforations, the printing press must be stopped or the perforation blade case 14 as a whole must be removed, thus requiring much labor and a time-consuming operation, degrading operation efficiency of the press and the productivity. As the perforation blade case 14 is frequently removed, its fastening bolts are damaged or loosened, or an operator may forget to tighten these bolts. If this occurs, the perforation blade 13 may accidentally be displaced due to centrifugal force from the perforation cylinder 7 rotating at high speed, and an accident may occur. In addition, when the above operations are not properly performed, the web may be torn, and folding precision may be degraded.

SUMMARY OF THE INVENTION

It is an object of the present invention to provide a horizontal perforation forming apparatus for a web rotary press, capable of improving operability and eliminating downtime of the rotary press since fine adjustment can be performed during operation at high speed while an operator is observing an actual folding operation.

It is another object of the present invention to provide a horizontal perforation forming apparatus for a web rotary press, capable of reducing waste of paper.

It is still another object of the present invention to provide a horizontal perforation forming apparatus for a web rotary press, capable of shortening printing preparation time, increasing productivity, and reducing labor.

In order to achieve the above objects of the present invention, there is provided a horizontal perforation forming apparatus for a rotary press in which a perforation blade extending in an axial direction of a perforation cylinder is set to oppose a perforation blade seat extending in an axial direction of a mating cylinder upon rotation of the perforation and mating cylinders, and horizontal perforations are formed by the perforation blade in a web which is traveling between the perforation and mating cylinders, which has an interaxial distance adjusting unit for adjusting a distance between axes of the perforation and mating cylinders.

When the perforation blade is, worn or printed patterns are changed to ones which do not require horizontal perforations, an interaxial distance between the perforation cylinder and its mating cylinder is adjusted and a gap between the perforation blade seat and the paper holder of the perforation blade case can be automatically adjusted to consider changes in conditions without removing the perforation blade case as a whole.

When an operation shaft of an interaxial distance adjusting unit is pivoted to adjust the interaxial distance between the perforation cylinder and its mating cylinder, the interaxial distance is adjusted, and at the same time, a phase adjusting axis is moved to automatically correct a horizontal perforation phase error caused upon adjustment of the interaxial distance between the perforation cylinder and its mating cylinder. Even when the phase adjusting shaft is pivoted to adjust the phase of the horizontal perforations, the operation shaft for the interaxial distance adjustment is not moved.

DETAILED DESCRIPTION OF THE PREFERRED EMBODIMENT

Figure 1:
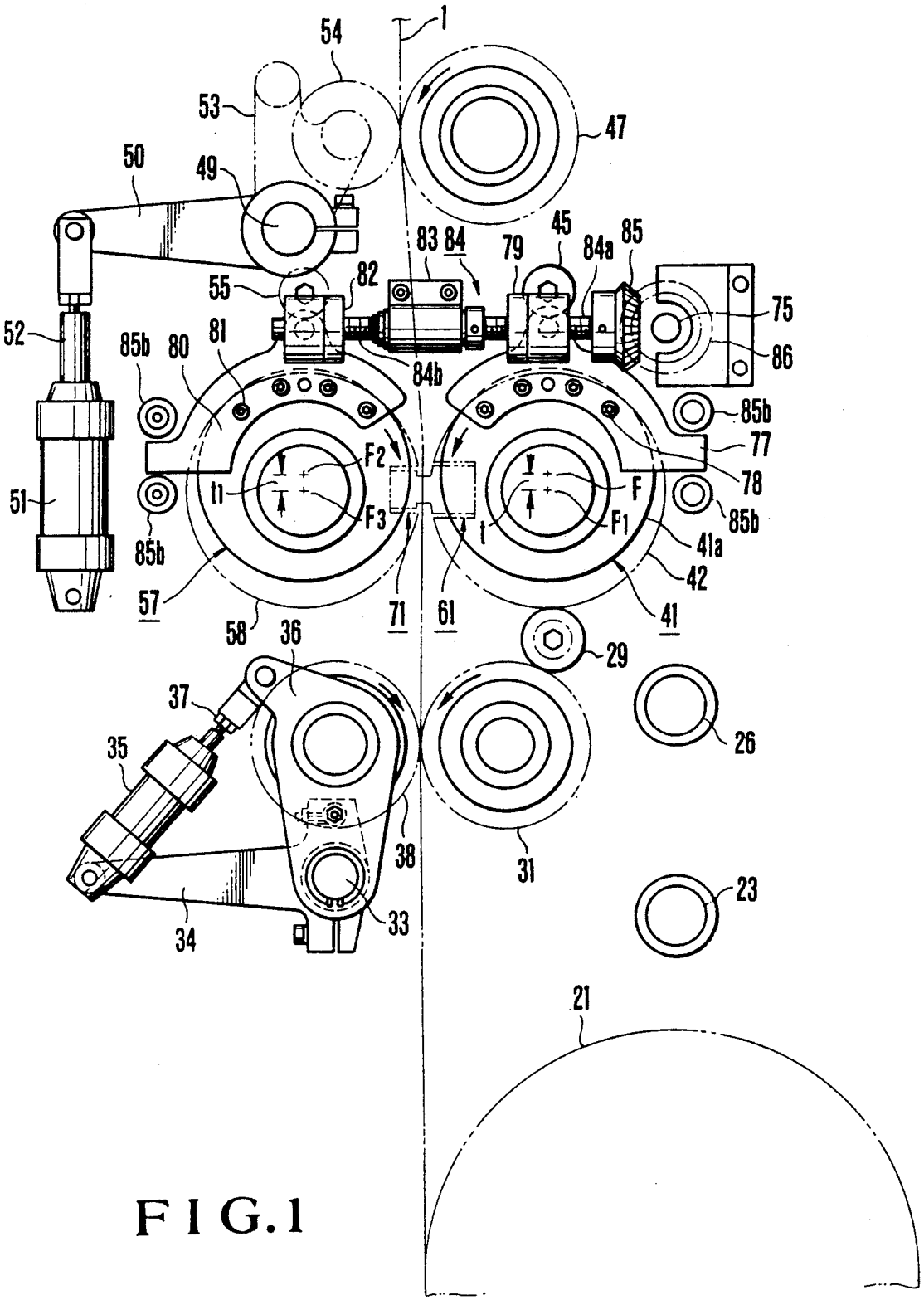
FIG. 1 is a side view of a horizontal perforation forming apparatus for a rotary press according to an embodiment of the present invention.

FIGS. 1 to 5 show a horizontal perforation forming apparatus according to an embodiment of the present invention.

Referring to FIGS. 1 to 5, a folding cylinder 21 constituted by folding paper cylinders brought into in rolling contact with a cutting cylinder (not shown) are rotatably supported by right and left frames 20 of a folder. A folding cylinder gear 22 coupled to a driving source is mounted on an end portion of the folding cylinder 21. A shaft 23 is stationarily supported on the frame 20 above the folding cylinder 21. A helical gear 24 meshed with the folding cylinder gear 22 is fitted on the shaft 23. A phase adjusting shaft 26 of a phase adjusting unit (to be described in detail later) at its end portion is axially movable above the shaft 23 so that rotation of the phase adjusting shaft 26 is restricted. A helical gear 27 meshed with the helical gear 24 and a helical gear 28 are integrally fixed on the phase adjusting shaft 26 so as to be rotatable but not to be slidable on the phase adjusting shaft 26. A gear shaft 29 extends on the frame 20 obliquely above the phase adjusting shaft 26. A helical gear 30 meshed with the helical gear 28 is pivotally fitted on the gear shaft 29. Reference numeral 31 denotes a lower nipping roller, both ends of which are rotatably supported by the left and right frames 20 and one end of which is located below the gear shaft 29. A helical gear 32 meshed with the helical gear 30 is mounted on the end portion of the lower nipping roller 31. The lower nipping roller 31 is driven by the folding cylinder 21 and is rotated in a direction indicated by an arrow. A pair of cylinder support shafts 33 extend on the frames 20 obliquely below both end portions of the lower nipping roller 31. Air cylinders 35 are supported by brackets 34 fixed on the cylinder support shafts 33 by split fastening, respectively. Reference numerals 36 denote a pair of right and left roller arms pivotally supported by the cylinder support shafts 33, respectively. Operation ends of piston rods 37 reciprocated by air pressures of the air cylinders 35 are supported at free end portions of the roller arms 36, respectively. Holder rollers 38 each having the same length of the lower nipping roller 31 are rotatably supported in the axial holes of the left and right roller arms 36, respectively. The holder or press rollers 38 again about the lower nipping roller 31 upon pivotal movement of the roller arms 36 and forward movement of the piston rods 37 of the air cylinders 35. A gear 39 at the shaft end portion is meshed with a gear 40 integrally mounted with the gear 32, so that the press roller 38 is rotated in a direction opposite to that of the lower nipping roller 31 in a direction indicated by an arrow.

A pair of right and left eccentric bearings 41 are pivotally supported on the frames 20 above the lower nipping roller unit having the above arrangement. Each eccentric bearing 41 is eccentric by an amount indicated by symbol t between an axis F of an outer circumferential circle 41*a* and an axis F1 of an inner circumferential circle 41*b*. A perforation cylinder 42 is rotatably supported by the inner circumferential circles 41*b* of the right and left eccentric bearings 41 through roller bearings 43. A cylinder gear 44 meshed with the helical gear 30 is mounted on the shaft end portion of the perforation cylinder 42. The perforation cylinder 42 is driven by the helical gear 30 and rotated in a direction indicated by an arrow in FIG. 1. The structure and pivotal mechanism of the perforation cylinder 42 will be described in detail later.

A gear 46 meshed with the cylinder gear 44 and located above the perforation cylinder 42 is rotatably fitted on a gear shaft 45 extending on one of the frames 20. An upper nipping roller 47 is rotatably supported by the right and left frames 20. A gear 48 fixed on its shaft end portion is meshed with the gear 46, so that the upper nipping roller 47 is rotated in a direction indicated by an arrow in FIG. 1. A lever shaft 49 is pivotally supported by the right and left frames 20 at a lateral position from the upper nipping roller 47. A lever 50 is fixed at one side end portion of the lever shaft 49 by split fastening. Reference numeral 51 denotes an air cylinder supported by the frame 20 on the lever 50 side. An operation end of a piston rod 52 of the air cylinder 51 is supported by the free end portion of the lever 50. Rubber rollers 54 are rotatably supported by roller arms 53 fixed at both ends of the lever shaft 49. With this arrangement, when the piston rod 52 of the air cylinder 51 is moved forward, the lever shaft 49 is pivoted through the lever 50. The rubber rollers 54 are brought into tight contact with the upper nipping roller 47 through the roller arms 53.

The gear 46 is meshed with a gear 56 mounted on a gear shaft 55 extending on the frame 20 at a lateral position of the gear shaft 45. A pair of right and left eccentric bearings 57 are pivotally supported on the frames 20 immediately below the gear shaft 55. Each eccentric bearing 57 is eccentric by an amount represented by reference symbol t1 between an axis F2 of an outer circumferential circle 57*a* and an axis F3 of an inner circumferential circle 57*b*. A mating cylinder 58 mating with the perforation cylinder 42 is rotatably supported by the inner circumferential circles 57*b* of the right and left eccentric bearings 57 through roller bearings 59. A cylinder gear 60 meshed with the gear 56 is mounted at an end portion of the mating cylinder 58. The mating cylinder 58 is driven by the gear 56 and is rotated in a direction indicated by an arrow in FIG. 1. That is, the mating cylinder 58 is not directly coupled to the perforation cylinder 42 driven by the driving source and is driven by the driven gear 46 of the perforation cylinder 42. A horizontal perforation forming line obtained by connecting the axis F3 of the mating cylinder 58 driven as described above and the axis F1 of the perforation cylinder 42 is set to be horizontal. Horizontal perforation forming is performed by the perforation cylinder 42 and the mating cylinder 58. A perforation blade groove 42*a* (best shown in FIG. 5) having a rectangular section is formed in the outer circumferential portion of the perforation cylinder 42 so as to extend in the axial direction. A perforation blade case 61 is stored in the perforation blade groove 42*a*. The perforation blade case 61 has an elongated perforation blade base 64, both end portions of which are fixed on the bottom surface of the perforation blade groove 42*a* by bolts 63 through an elongated plate-like shim 62; a paper holder 65 having the same length as that of the perforation blade base 64 and dovetailed with the base 64; a holder plate 66 screwed on the perforation blade base 64 to hold the perforation blade base 64 and the paper holder 65 from both sides of the holder plate 66; and an elongated plate-like perforation blade 68 which is engaged with the perforation blade groove 42*a* formed between the perforation blade base 64 and the paper holder 65 and is fixed by a plurality of bolts 67. The distal end of the perforation blade 68 extends from the paper holder 65. Reference numeral 69 denotes an adjusting screw which is threadably engaged with a screw hole formed in the bottom surface of the perforation blade base 64 so as to be reciprocated therein. A perforation blade receiving groove 58*a* having a rectangular section is formed in the outer circumferential portion of the mating cylinder 58 so as to extend in the axial direction thereof. Elongated perforation blade seats 71 split in the widthwise direction and formed integrally by a bolt 70 are stored in the perforation blade receiving groove 58*a* and are fixed on the bottom surface of the perforation blade receiving groove 58*a*. A groove 71*a* is formed on the outer end face of the perforation blade seat 71 to receive the distal end of the perforation blade 68. With this arrangement, when the web 1 passes between the perforation cylinder 42 and the mating cylinder 58, and the perforation blade case 61 opposed the perforation blade seat 71, the perforation blade 68 is engaged with the groove 71*a* to form perforations at a prospective folding portion of the web 1.

The horizontal perforation forming apparatus having the above arrangement includes an interaxial distance adjusting unit for simultaneously moving the perforation cylinder 42 and the mating cylinder 58 to adjust an interaxial distance between these cylinders. That is, an operation shaft 75 is pivotally supported in a bracket 74 fixed outside one frame 20 near the perforation cylinder 42 and the axial hole formed in the other frame 20. A handle 76 is fixed to an extended end portion of the operation shaft 75. Arcuated stud holders 77 are fixed on outer circumferential portions of the right and left eccentric bearings 41 by pluralities of bolts 78, respectively. Studs 79 are respectively engaged with the central portions of the stud holders 77 such that polygonal heads of the studs 79 extend outward from the stud holders 77. Arcuated stud holders 80 are fixed on the outer circumferential portions of the right and left eccentric bearings 57 by pluralities of bolts 81, respectively. Studs 82 are respectively engaged with the central portions of the stud holders 80 such that polygonal head portions of the studs 82 extend outward from the stud holders 80. Reference numeral 83 denotes a bearing located between the corresponding pair of studs 79 and 82 and fixed to the corresponding frame 20. Screw shafts 84 are pivotally supported by the bearings 83, respectively. A counterclockwise screw 84*a* of each screw shaft 84 is threadably reciprocated in a screw hole of the corresponding stud 79. A clockwise screw 84*b* of each screw shaft 84 is threadably reciprocated in a screw hole of the corresponding stud 82. A bevel gear 85 fixed to one end of each screw shaft 84 is meshed with a corresponding bevel gear 86 on the operation shaft 75. When the operation shaft 75 is pivoted with the handle 76 to pivot both the screw shafts 84 through meshing between the bevel gears 85 and 86, the stud holders 77 and the stud holders 80 are moved in opposite directions through the studs 79 and 82 by the threadable action of the counterclockwise and clockwise screws 84*a* and 84*b*. As a result, the eccentric bearings 41 and 57 are pivoted at fitting portions of the outer circumferential circles 41*a* and 57*a*. The axes F1 and F3 of the inner circumferential circles 41*b* and 57*b* are pivoted about the axes F and F2 of the outer circumferential circles 41*a* and 57*a* by eccentric action. The perforation blade case 61 and the perforation blade seat 71 are moved in opposite directions, so that a gap between the paper holder 65 and the perforation blade seat 71 can be adjusted. In this apparatus, positions of the gears 30, 46, 60, and 56 are determined such that a line obtained by connecting the center of the driving gear 30 for the perforation cylinder 42 and the center of the driven gear 46 and a line obtained by connecting the cylinder gear 60 of the mating cylinder 58 and the upper gear 56 are almost perpendicular to a line obtained by connecting the centers of the perforation cylinder 42 and the mating cylinder 58. The axes F1 and F3 are moved to the eft and right from a position corresponding to a state (FIG. 1) in which the axes F1 and F3 are located immediately below the axes F and F2. Reference numerals 85*b* denote stoppers for limiting movement of both ends of each of the stud holders 77 and 80 fixed on the frame 20.

A phase adjusting unit 25 will be described below. The phase adjusting shaft 26 is supported so that pivotal movement is restricted and axial movement toward the frame 20 is allowed by a key 87. A screw shaft 90 having a handle 89 and supported by a bearing 88 on the frame 20 is threadably engaged with a screw hole 26*a* formed at one end of the phase adjusting shaft 26 such that axial movement of the screw hole shaft 90 is inhibited. With this arrangement, when an operator holds and turns the handle 89 to pivot the screw shaft 90, the phase adjusting shaft 26 is axially reciprocated by the threadable action, and the cylinder gear 44 is slightly pivoted through the helical gear 30 by the helical gear action of the helical gear 28. The perforation cylinder 42 is slightly pivoted accordingly, and the phase of the perforation cylinder 42 with respect to the stationary folding cylinder 21 can be adjusted. Reference numeral 91 denotes a lock handle for fixing the screw shaft 90 upon pivotal movement. The helical gear 24 on the shaft 23 is formed to be axially movable. Upon axial movement of the helical gear 24, lap adjustment for one parallel folding operation is performed.

An operation of the horizontal perforation forming apparatus having the above arrangement will be described below. The printed and conveyed web 1 is fed out by the upper nipping roller 47 and is guided between the perforation cylinder 42 and the mating cylinder 58. After the web 1 passes through the perforation cylinder 42 and the mating cylinder 58, the web 1 is guided to a gap between the folding cylinder 21 and the cutting cylinder by the lower nipping roller 31. Horizontal perforations are formed by the perforation blade 68 in the web 1 passing through the perforation cylinder 42 and the mating cylinder at intervals each corresponding to a circumferential length of each of the perforation cylinder 42 and the mating cylinder 58 every time the perforation blade seat 71 opposes the groove 71*a*. The web 1 is folded at a perforation position by the folding cylinder 21. Therefore, excellent folding precision can be easily obtained.

When the thickness of the web 1 is changed or a distal end of the perforation blade 68 is worn, a gap between the paper holder 65 and the perforation blade seat 71 must be adjusted. In this case, the operator holds and turns the handle 76 to pivot the operation shaft 75. When both the screw shafts 84 are synchronously rotated through meshing between the bevel gears 85 and 86, the studs 79 and the stud holders 77 on the perforation cylinder 42 side are circumferentially moved in a direction opposite to that of the studs 82 and the stud holders 80. As a result, the eccentric bearings 41 and 57 are pivoted at the fitting portions of the outer circumferential circles 41*a* and 57*a*. The perforation cylinder 42 and the mating cylinder 58 are pivoted in opposite directions such that the axes F1 and F3 of the inner circumferential circles 41*b* and 57*b* are pivoted about the axes F and F2 of the outer circumferential circles 41*a* and 57*a*. The perforation blade case 61 and the perforation blade seat 71 are moved, and a gap between the paper holder 65 and the perforation blade seat 71 is adjusted.

In this case, in the apparatus of this embodiment, a direction of eccentric direction obtained by connecting the axes F1 and F and a line of eccentric direction obtained by connecting the axes F3 and F2 are almost perpendicular to a horizontal perforation forming line obtained by connecting the axes of the perforation cylinder 42 and the mating cylinder 58. When a state of FIG. 4(*a*) is changed to that of FIG. 4(*b*), a change in interaxial distance by eccentricity is effectively applied as an extension amount of the perforation blade 68, as indicated by $\Delta x$. In addition, since the perforation cylinder 42 and the mating cylinder 58 are simultaneously moved in the opposite directions, a difference in rotational phase generated in the drive gear upon movement by the distance $\Delta x$ is canceled. The perforation blade 68 will not be removed from the groove 71*a* of the perforation blade seat 71.

A line obtained by connecting the driven gear 46 and the driving gear 30 meshed with the cylinder gear 44 of the perforation cylinder 42 and a line obtained by connecting the driving gear 56 and the cylinder gear 60 of the mating cylinder 58 are almost perpendicular to a line angularly spaced apart from the vertical axis by the distance $\Delta x$. A change $\Delta a$ in interaxial distance a between the cylinder gear 44 and the driving gear 30 by an eccentric amount t and an adjusting angle $\phi$ shown in FIG. 4(*b*) can be minimized. Similarly, an interaxial distance between the cylinder gear 44 and the driven gear 46 and an interaxial distance between the driving gear 56 and the cylinder gear 60 of the mating cylinder 58 can be minimized. In addition, the perforation cylinder 42 is not directly coupled to the mating cylinder 58, i.e., the mating cylinder 58 is driven by the gear 56 located in almost the same direction as the eccentric direction. Therefore, a change in interaxial distance between the cylinders cannot be directly transmitted as a change in interaxial distance between the gears.

Figure 4A:
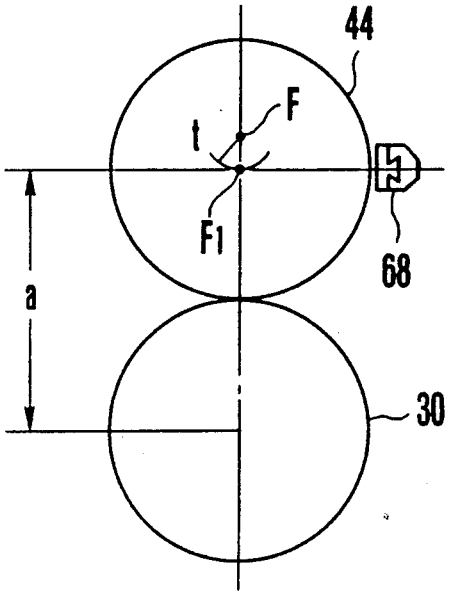
FIGS. 4(*a*) and 4(*b*) are side views showing a perforation cylinder and driving gears to explain changes in meshing if gears upon movement of the perforation cylinder.
Figure 4B:
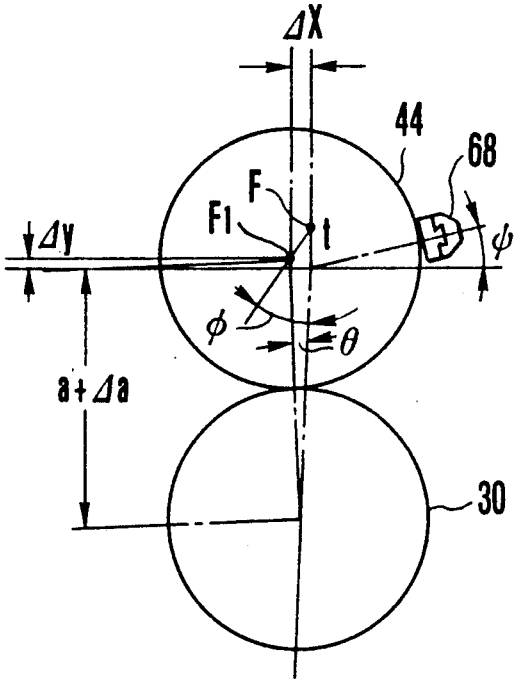
Figure 5:
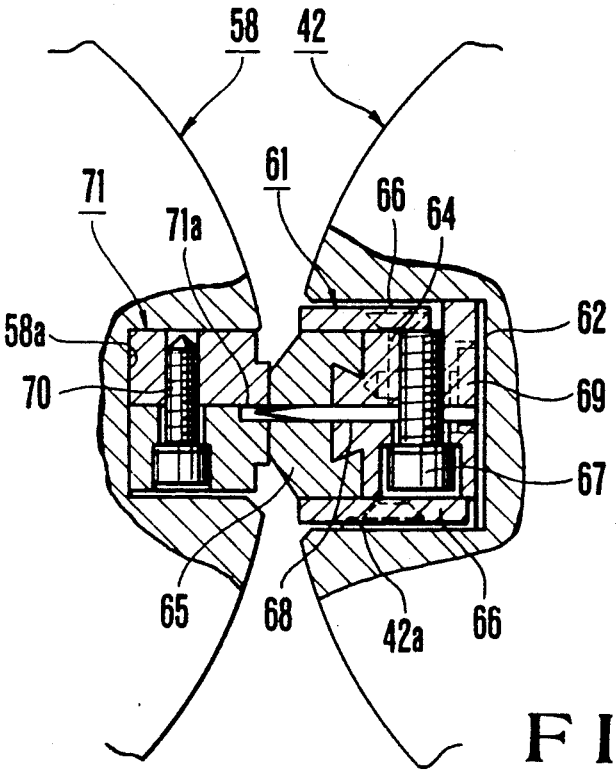
FIG. 5 is an enlarged sectional view of a perforation blade case and a perforation blade seat.

Referring to FIGS. 4(*a*) and 4(*b*), when the perforation cylinder 42 is displaced by the eccentric amount t and the adjusting angle $\phi$, a change in angle $\theta$ occurs between the perforation cylinder 42 and the driving gear 30 for driving the driving force to the cylinder gear 44, thus causing a rotational phase error $\psi$ of the perforation blade 68. In the apparatus of this embodiment, since the same amount of change occurs in the mating cylinder 58 in a direction opposite to that of the perforation cylinder 42, a phase error $\psi$ also occurs in the mating cylinder 58. In this case, however, the perforation blade 68 will not be removed from the groove 71*a* of the perforation blade seat 71 by the phase error $\psi$.

This embodiment employs involute gears. Even if an interaxial distance between the gears is changed, proper meshing can be achieved. When the normal interaxial distance a is changed, a pressure angle $\alpha$ is changed and backlash c is also changed. If the interaxial distance is increased by $\Delta a$, the pressure $\alpha$ and the backlash c are also changed. In this embodiment, as described above, since the direction corresponding to the distance a is set to be almost perpendicular to a direction corresponding to the distance $\Delta x$, a change $\Delta c$ in backlash of the gear can be minimized with respect to a change $\Delta x$. In addition, since the pivotal limitations of the eccentric bearings 41 are restricted by the stoppers 85*b*, the backlash will not exceed a predetermined backlash range.

The paper holder 65 in the perforamtion blade case 61 is made of a soft elastic material and is extendible in the radial direction of the perforation cylinder 42. Even if a distance between the mating cylinder 58 and the perforation blade case 61 including the paper holder 65 is changes, this change can be absorbed as a change in the paper holder 65 and, therefore, does not have an amount which adversely affects quality of the printed matters.

Figure 3:
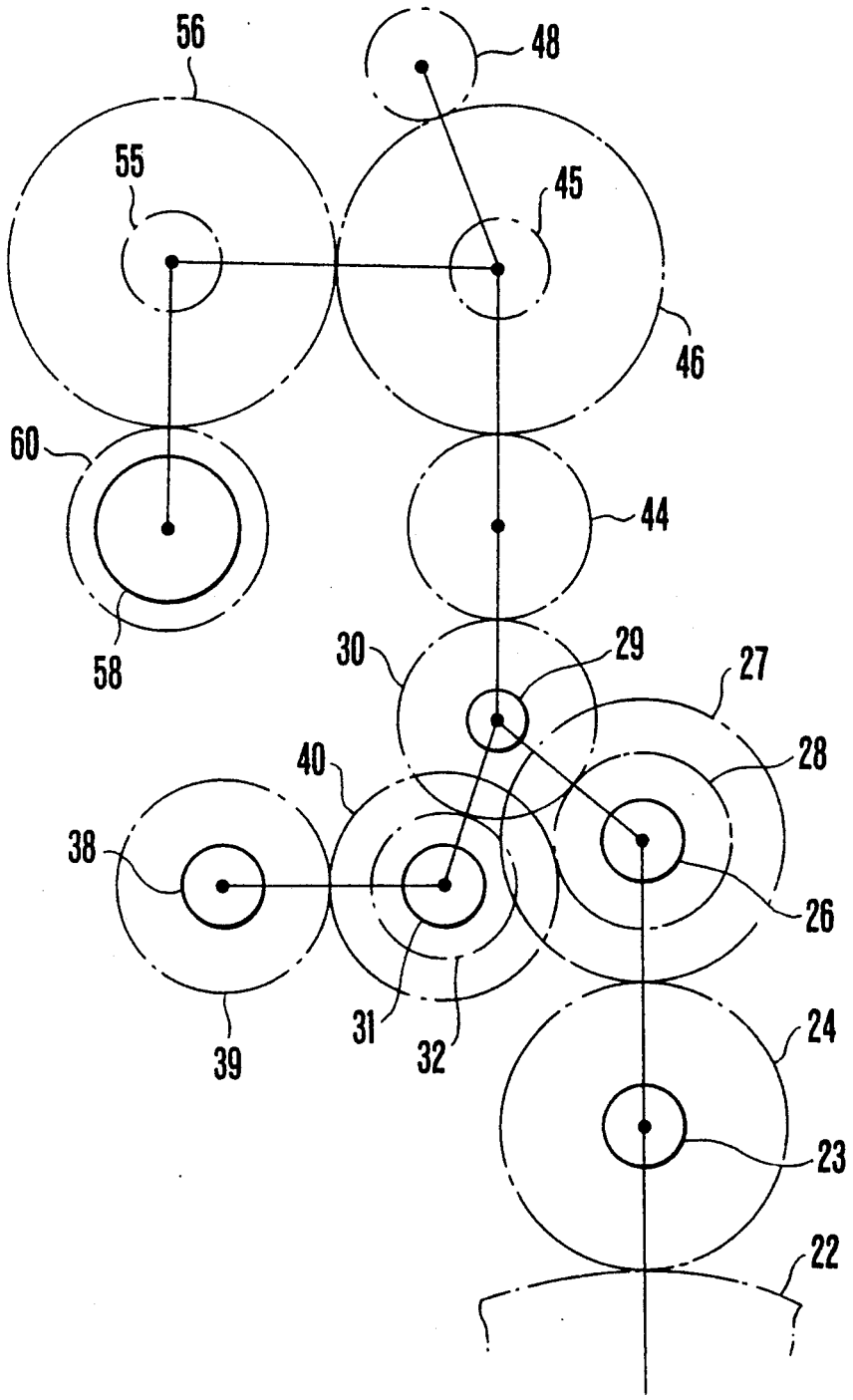
FIG. 3 is a side view showing a gear train to explain gear meshing when viewed from the same side as in FIG. 1.
Figure 6:
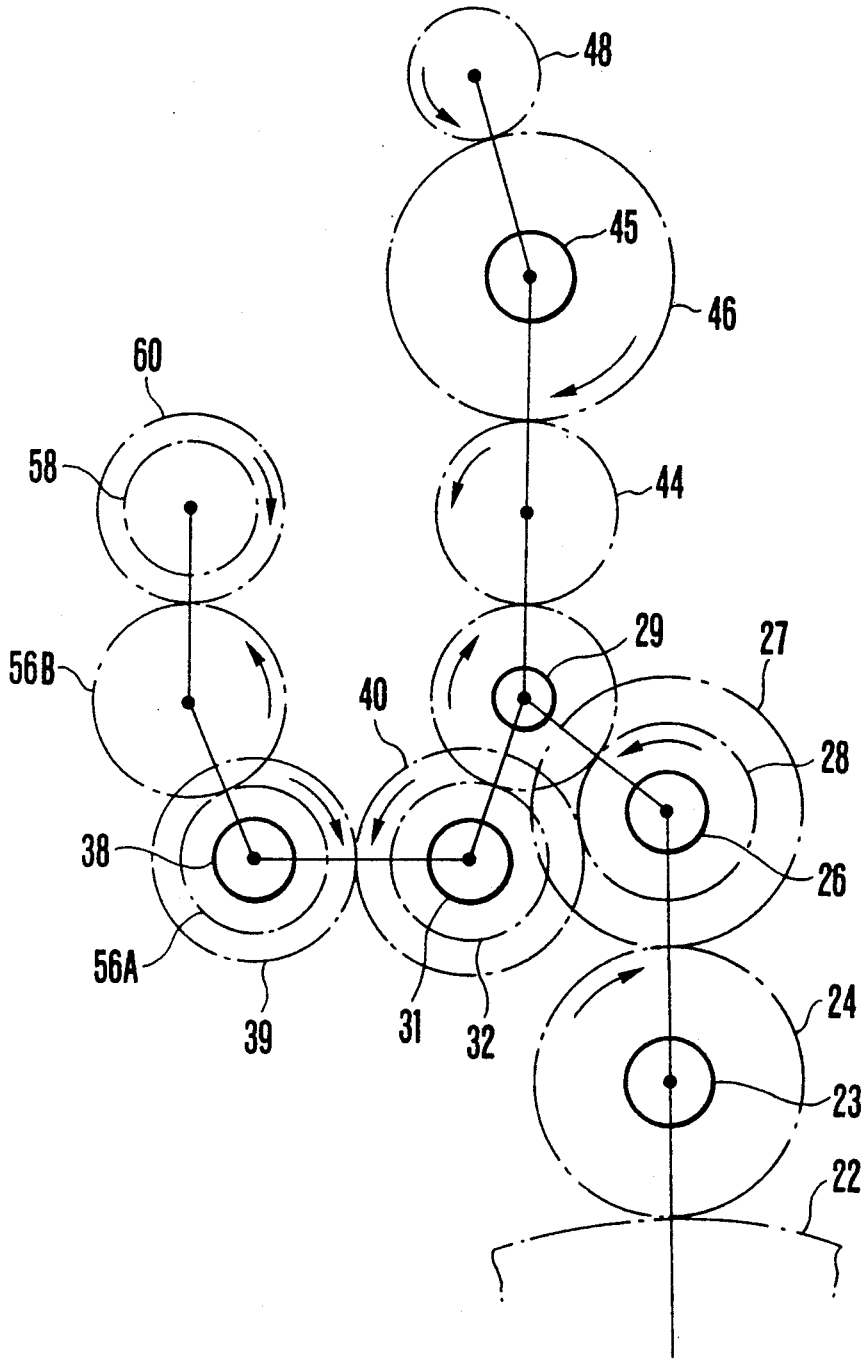
FIG. 6 is a side view of a gear train viewed from the same side as in FIG. 1 according to another embodiment of the present invention.

FIG. 6 is a side view of a gear train according to another embodiment of the present invention when viewed from the same side as in FIG. 1 in correspondence with FIG. 3. In the embodiment of FIG. 6, the gear 56 is eliminated, and instead, a gear 56A coaxial with a gear 39 and a gear 56B meshed with a gear 60 are provided to drive a mating cylinder 58 from the driving side of a perforation cylinder 42. A line obtained by connecting the centers of the gears 60 and 56B is set to be almost perpendicular to a horizontal perforation forming line. With this arrangement, the same effect as in the previous embodiment can be obtained.

Figure 2:
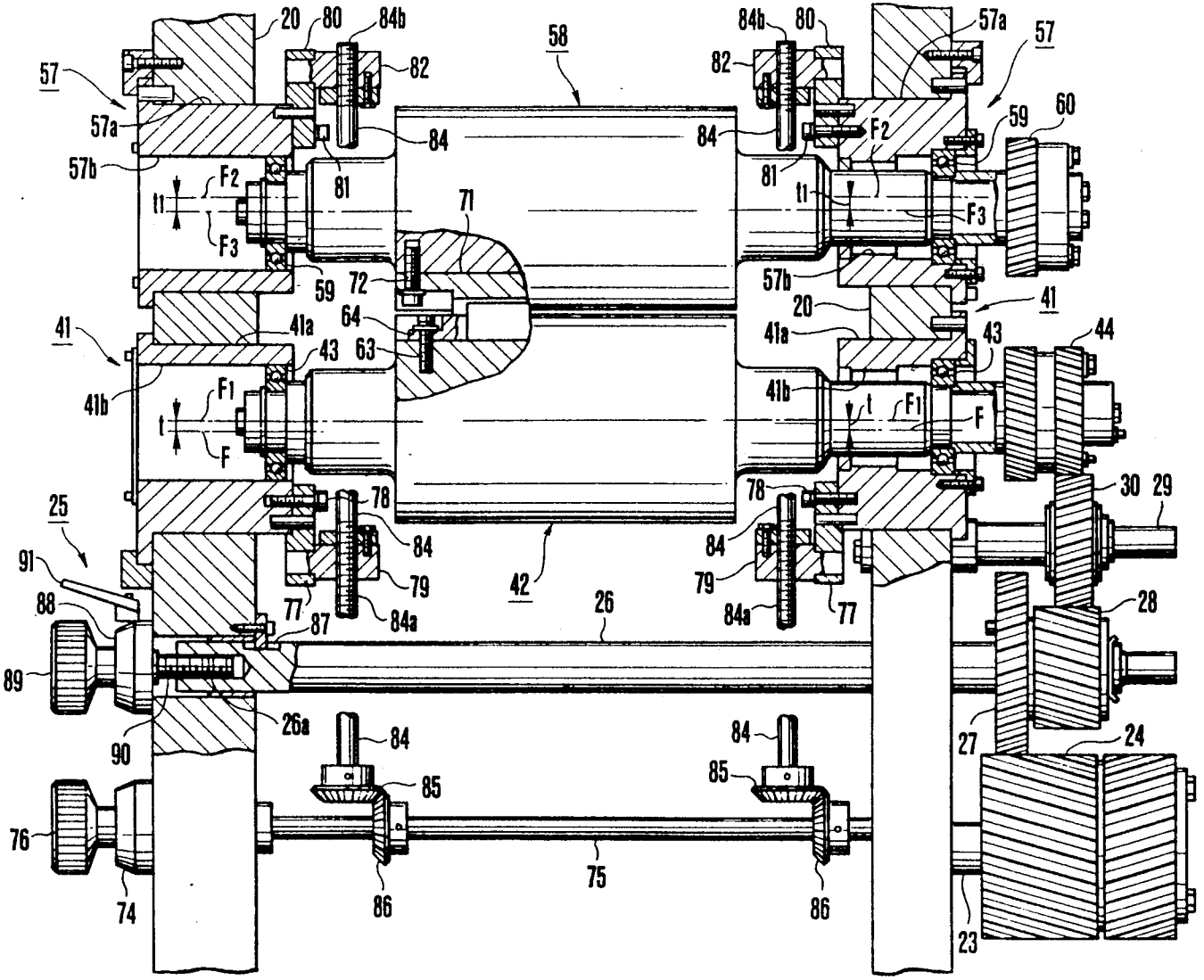
FIG. 2 is a partially cutaway developed plan view of the horizontal perforation forming apparatus shown in FIG. 1.
Figure 7:
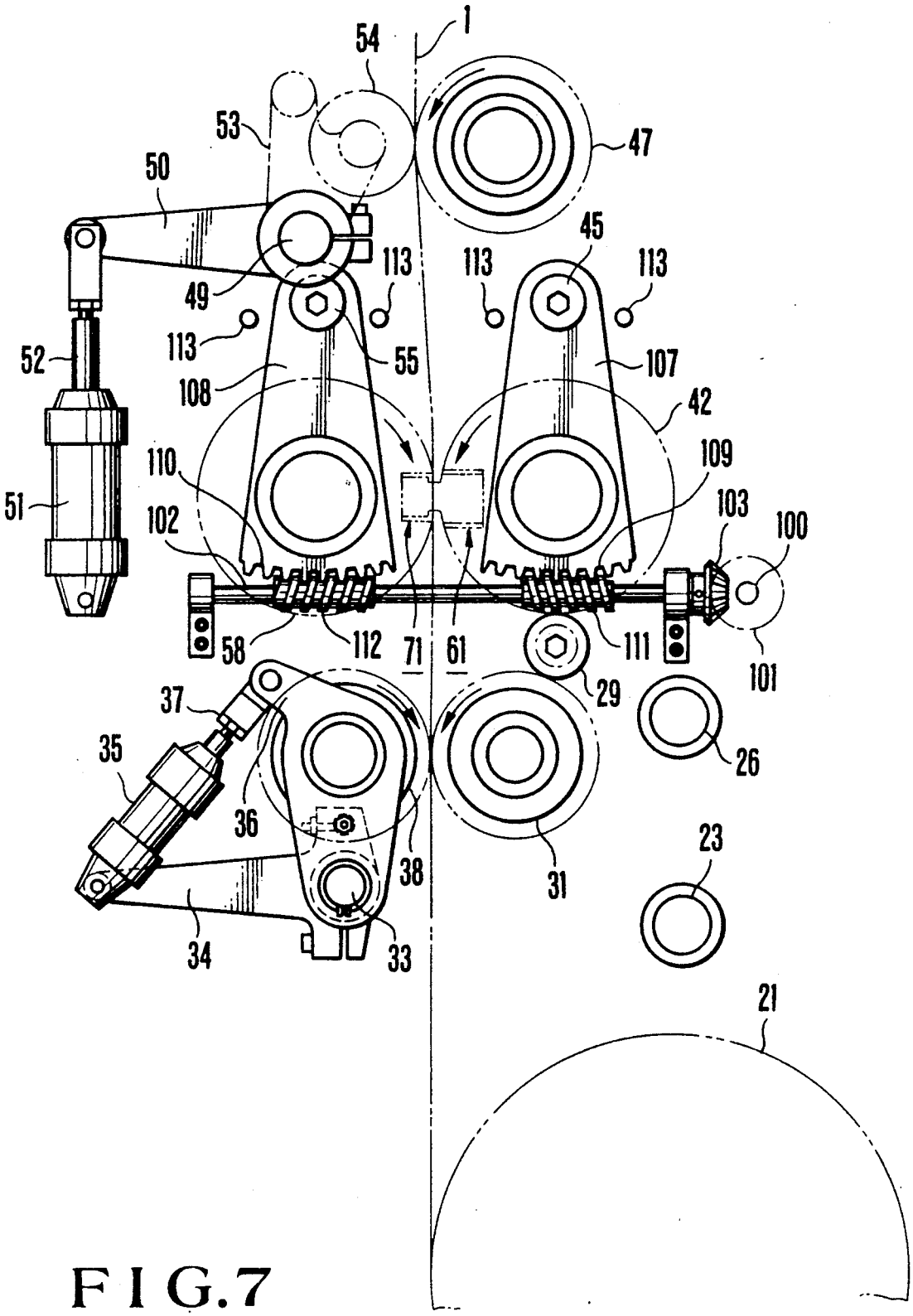
FIG. 7 is a side view of a horizontal perforation forming apparatus according to still another embodiment of the present invention.
Figure 8:
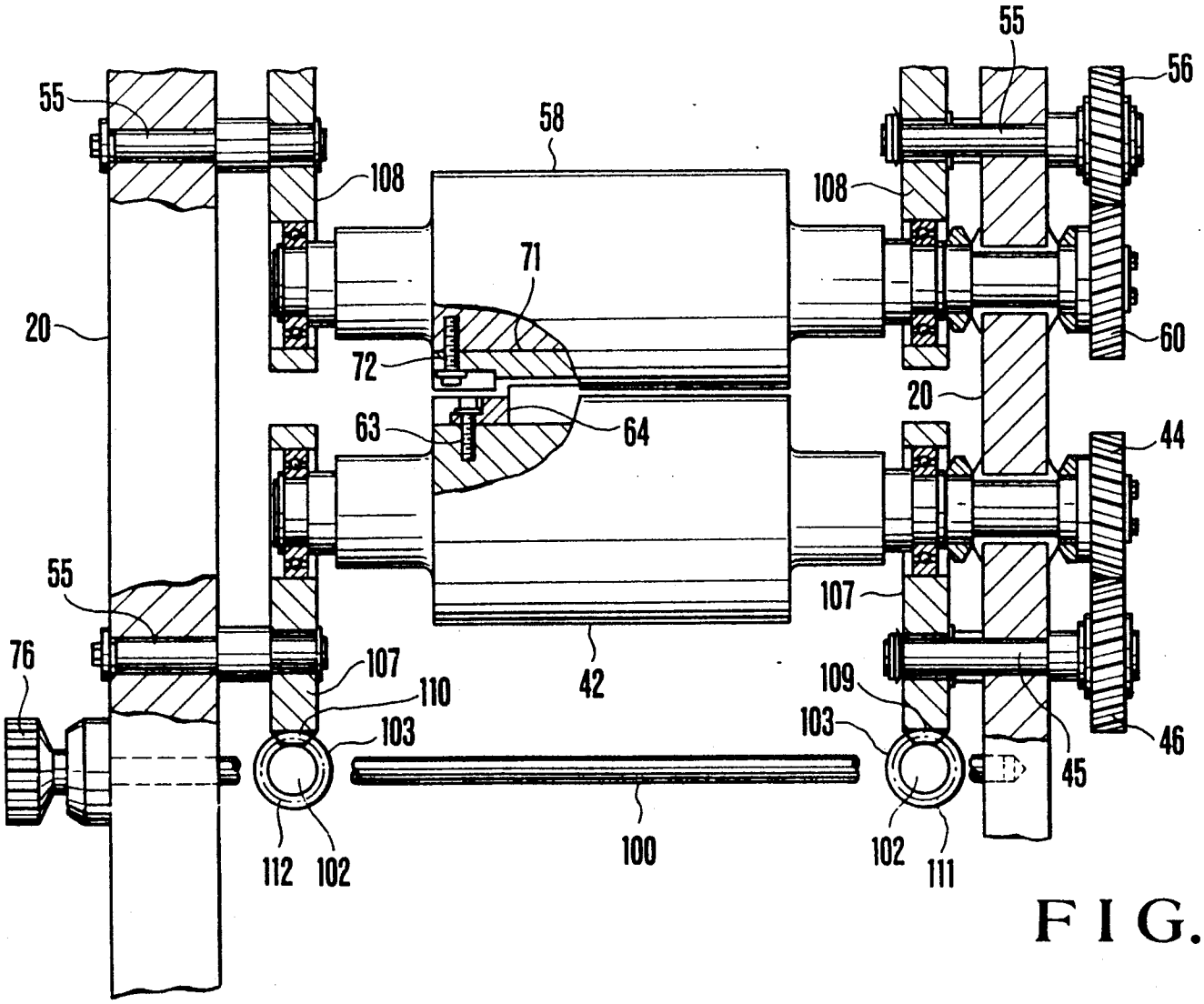
FIG. 8 is a partially cutaway developed front view of the embodiment shown in FIG. 7.
Figure 9:
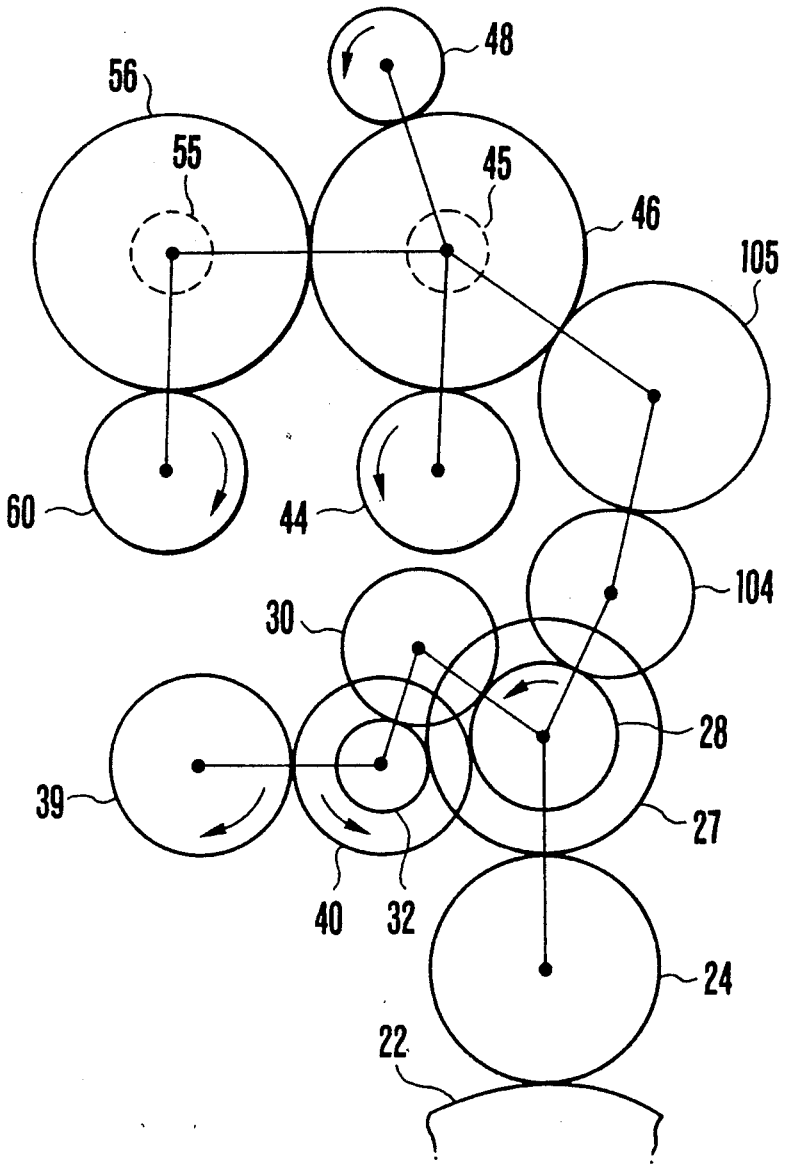
FIG. 9 is a side view of a gear train when viewed from the same side as in FIG. 1 according to the embodiment shown in FIG. 7.

FIGS. 7 to 9 show still another embodiment of the present invention. More specifically, FIG. 7 shows a horizontal perforation forming apparatus when viewed in correspondence with FIG. 1, FIG. 8 shows it in correspondence with FIG. 2, and FIG. 9 shows a state when viewed from the same side as in FIG. 1 so as to explain gear meshing. The same reference numerals as in FIGS. 1 to 3 denote the same parts in FIGS. 7 to 9, and a detailed description thereof will be omitted.

In the embodiment of FIGS. 7 to 9, an operation shaft 100 corresponding to the operation shaft 75 of the previous embodiment is located obliquely below a perforation cylinder 42 and is supported by right and left frames 20. A handle 76 is attached to the operation shaft 100. A pair of bevel gears 101 are mounted on the operation shaft 100 near the right and left frames 20. The bevel gears 101 are meshed with bevel gears 103 mounted on worm shafts 102 extending parallel to the frames 20, respectively. A cylinder gear 44 of the perforation cylinder 42 meshed with and driven by a gear 30 in the previous embodiment is disengaged from the gear 30. The cylinder gear 44 is driven by a driving gear 46 through gears 104 and 105 which are sequentially meshed with the gear 30. A gear 60 on the side of a mating cylinder 58 is driven by a driving gear 56 meshed with the gear 46. A line obtained by connecting the centers of the gears 46 and 44 and a line obtained by connecting the centers of the gears 56 and 60 are almost perpendicular to a horizontal perforation forming line as in the previous embodiment. A right pair of gear shafts 45 and 55 and a left pair of gear shafts 45 and 55 are fixed on the right and left frames 20, respectively. Sector-shaped levers 107 and 108 are respectively pivotally supported by the gear shafts 45 and 55 inside the corresponding frame 20. The perforation cylinder 42 and the mating cylinder 58 are rotatably supported by free end portions of the levers 107 and 108 through bearings. Worm wheels 109 and 110 are formed at the free ends of the levers 107 and 108, respectively. These worm wheels 109 and 110 are respectively meshed with clockwise and counterclockwise worm gears 111 and 112 mounted on the corresponding worm shaft 102. Reference numerals 113 denote stoppers for defining pivotal limitations of the levers 107 and 108.

When the thickness of the web 1 is changed or the distal end of a perforation blade 68 is worn, the gap between a paper holder 65 and a perforation blade seat 71 must be adjusted. In this case, with the above arrangement, the operator holds and turns the handle 76 to pivot the operation shaft 100, and the worm shafts 102 are rotated through meshing between the bevel gears 101 and 103. The levers 107 and 108 are swung upon meshing with the clockwise and counterclockwise worm gears 111 and 112, thereby adjusting an interaxial distance between the perforation cylinder 42 and the mating cylinder 58. As a result, the perforation blade case 61 and the perforation blade seat 71 are moved to adjust a gap between the paper holder 65 and the perforation blade seat 71. In this case, a line obtained by connecting the centers of the gears 46 and 44 and a line obtained by connecting the centers of the gears 56 and 60 are symmetrical with each other about the traveling line of the web 1. Even if the perforation cylinder 42 and the mating cylinder 58 are moved, the phase of the perforation blade case 61 in the circumferential direction is always matched with the phase of the perforation blade seat 71 in the same direction, as in the previous embodiment. It is, therefore, readily understood that the perforation blade case 61 need not be removed when printing is to be changed to printed matters which do not require horizontal perforation formation or the interaxial distance is to be adjusted. In addition, since the levers 107 and 108 are pivoted about the gear shafts 45 and 55, no problem is posed in meshing between gears 46, 44, 56, 60, and 105 and the like.

Figure 10:
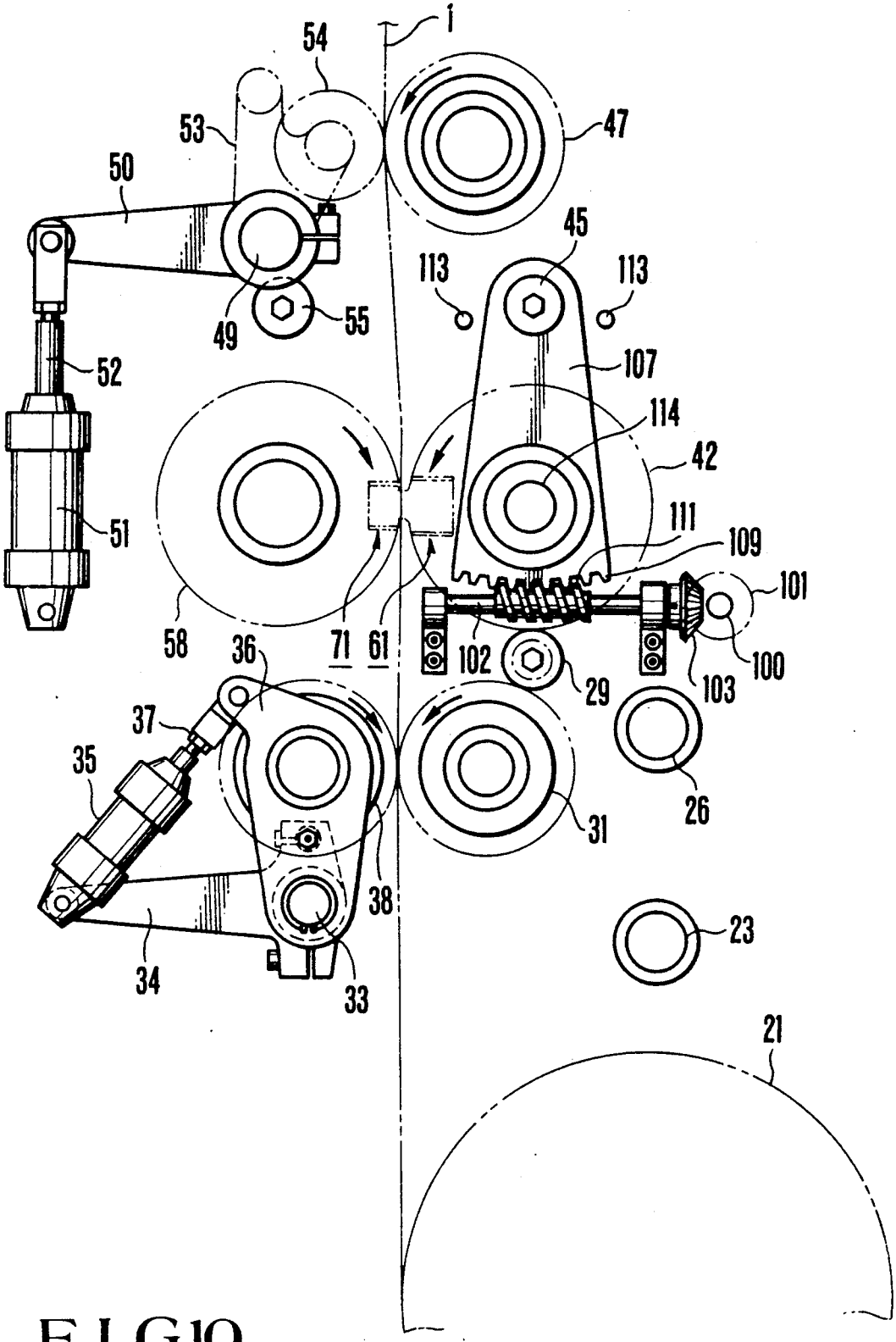
FIG. 10 is a side view of a horizontal perforation forming apparatus according to still another embodiment of the present invention.
Figure 11:
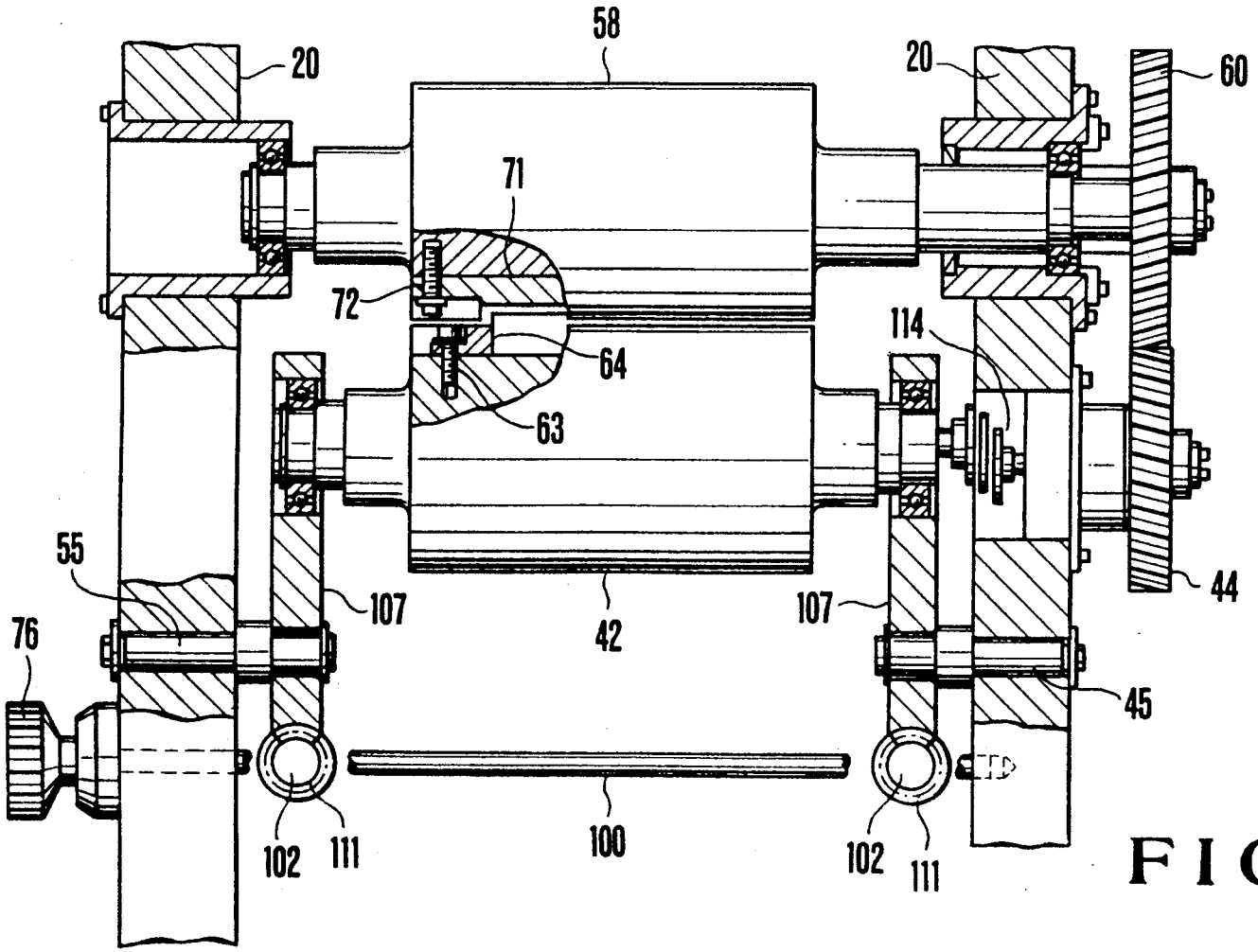
FIG. 11 is a partially cutaway developed front view of the embodiment shown in FIG. 10.
Figure 12:
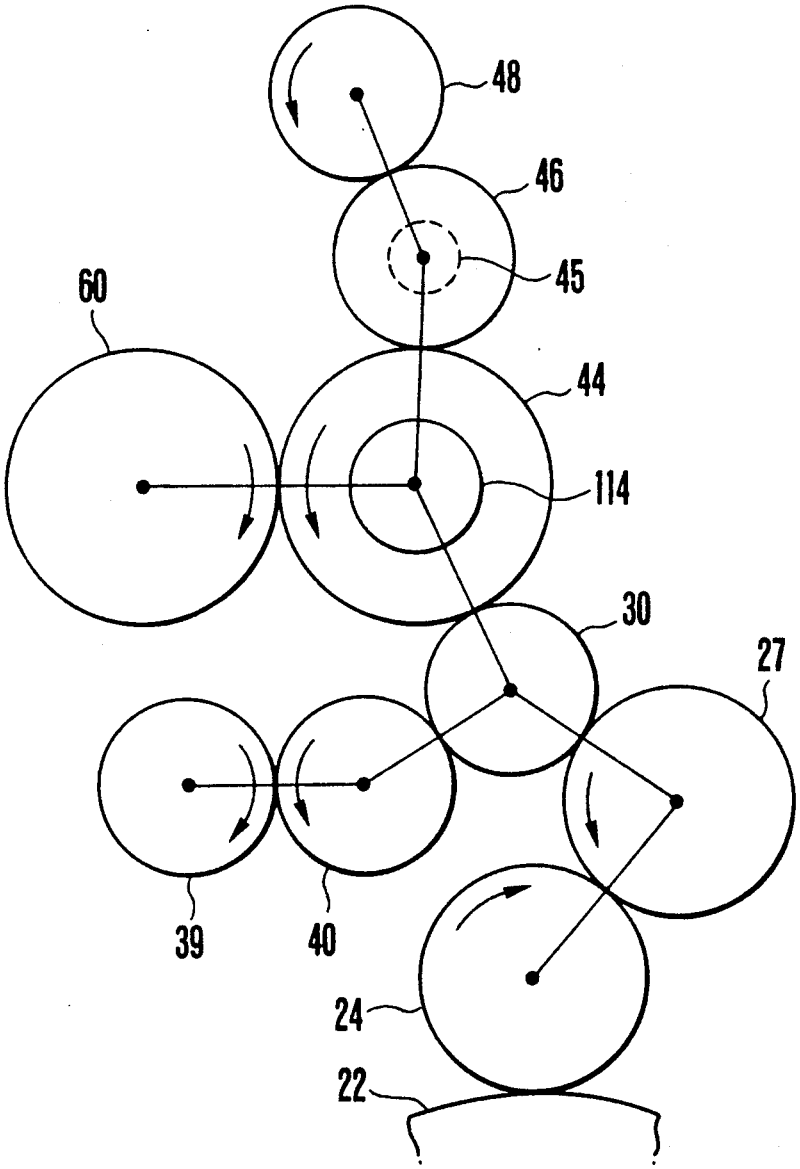
FIG. 12 is a side view of a gear train when viewed from the same side as in FIG. 7 according to the embodiment of FIG. 10.

FIGS. 10 to 12 show still another embodiment of the present invention. More specifically, FIG. 10 shows a horizontal perforation forming apparatus in correspondence with FIG. 7, FIG. 11 shows it in correspondence with FIG. 8, and FIG. 12 shows a gear train when viewed from the same side as in FIG. 1 in correspondence with FIG. 9. The same reference numerals as in FIGS. 7 to 9 denote the same parts in FIGS. 10 to 12, and a detailed description thereof will be omitted.

In the embodiment of FIGS. 10 to 12, each worm shaft 102 coupled to an operation shaft 100 through corresponding bevel gears 101 and 103 has ½ the length of the worm shaft 102 of the embodiment of FIGS. 7 to 9. Each lever 107 connected to the corresponding worm shaft 102 through a corresponding worm gear 111 and a corresponding worm wheel 109 is pivoted on only the side of a perforation cylinder 42. A cylinder gear 44 of the perforation cylinder 42 is meshed with a driving gear 30 and a driven gear 46 and also meshed with a cylinder gear 60 of a mating cylinder 58. Both ends of the perforation cylinder 42 are supported by the levers 107 through bearings, respectively. One end of the perforation cylinder 42 is connected to a shaft fixed to the cylinder gear 44 through an eccentric shaft coupling 114 generally called a Schmitt coupling. In the eccentric shaft coupling 114 called the Schmitt coupling, a support portion on the perforation cylinder 42 side and a support portion on the side of the shaft to which the cylinder gear 44 is fixed are formed to be eccentric. Even if the levers 107 are swung, the angular phase of the perforation cylinder 42 is not changed with respect to the cylinder gear 44.

Assume that a gap between the paper holder 65 and a perforation blade seat 71 must be adjusted because the thickness of a web 1 is changed or the distal end of a perforation blade 68 is worn. In this case, with the above arrangement, the operator holds and turns a handle 76 to pivot the operation shaft 100 and then worm shafts 102 through meshing with the bevel gears 101 and 103. The levers 107 are swung upon meshing between the worm gears 111 and the worm wheels 109 to adjust a gap between an interaxial distance between the perforation cylinder 42 and the mating cylinder 58. As a result, a perforation blade case 61 and the perforation blade seat 71 are moved to adjust a gap between the paper holder 65 and the perforation blade seat 71. In this case, since only the eccentric shaft coupling 114 is made eccentric, no angular phase error occurs between the perforation cylinder 42 and the cylinder gear 44. A total eccentric error between the perforation blade case 61 and the perforation blade seat 71 is caused by only the eccentric action. That is, only a small error occurs, and the phase of the mating cylinder 58 need not be adjusted. Note that the perforation blade case 61 need not be removed when printing is to be changed to printed matters which do not require horizontal perforation formation or an interaxial distance is to be adjusted. Since the levers 107 are pivoted about the gear shafts 45, no problem is posed in meshing of the gears 46, 44, and 60.

In this embodiment, the perforation gear 44 is coupled to the perforation cylinder 42 through the eccentric shaft coupling 114. The number of gears can be reduced, and the structure can be simplified. If a Schmitt coupling is used as the eccentric shaft coupling, the angular velocity is not changed even if an eccentric operation is performed, thus coping with high-speed operation with a high torque.

Figure 13:
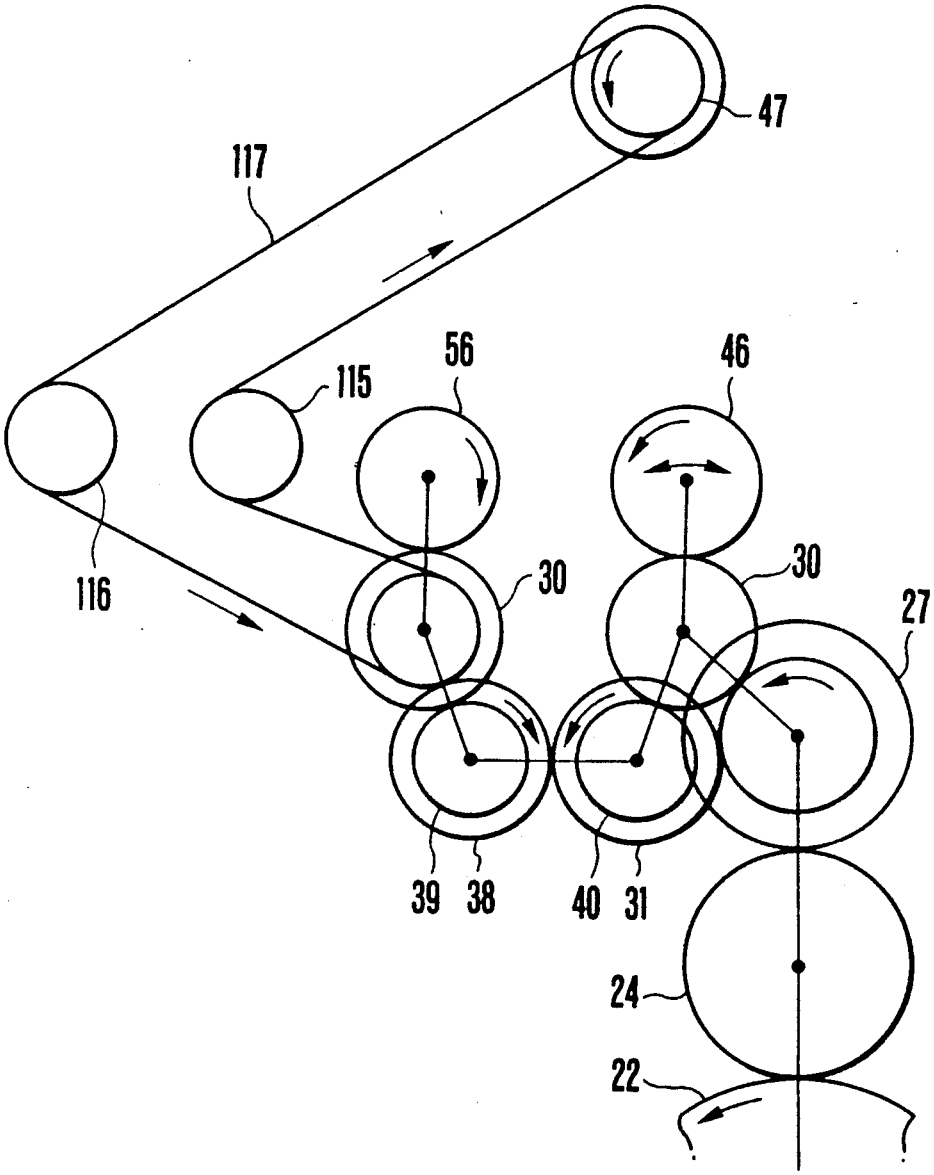
FIG. 13 is a view showing a gear arrangement according to still another embodiment of the present invention.

FIG. 13 is a view showing a gear arrangement according to still another embodiment of the present invention. In this embodiment, a timing belt 117 is looped between an upper nipping roller 47 and a mating cylinder 58 while the timing belt 117 is kept taut by tensioners 115 and 116. The number of gears can be further reduced.

Figure 14:
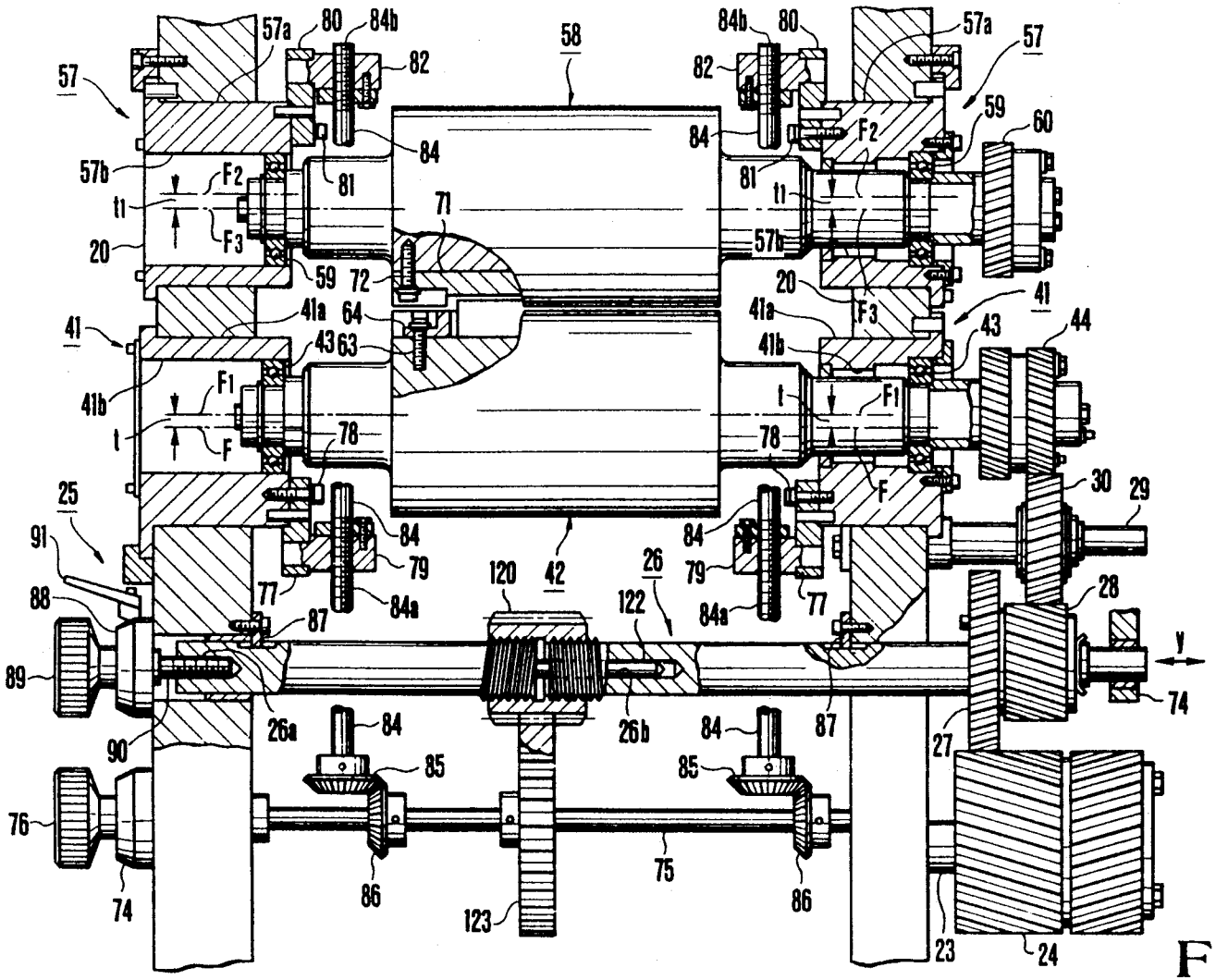
FIG. 14 is a longitudinal sectional view of a horizontal perforation forming apparatus according to still another embodiment of the present invention.

FIG. 14 is a longitudinal sectional view of a horizontal perforation forming apparatus according to still another embodiment of the present invention. The same reference numerals as in the embodiment of FIG. 2 denote the same parts in the embodiment of FIG. 14, and a detailed description thereof will be omitted. The gear arrangement of this embodiment is the same as that of FIG. 3 and will be described with reference to FIG. 3. The embodiment of FIG. 14 aims at eliminating a phase error of the horizontal perforation during interaxial distance adjustment. The phase error will be described with reference to the gear layout of FIG. 15.

Figure 15:
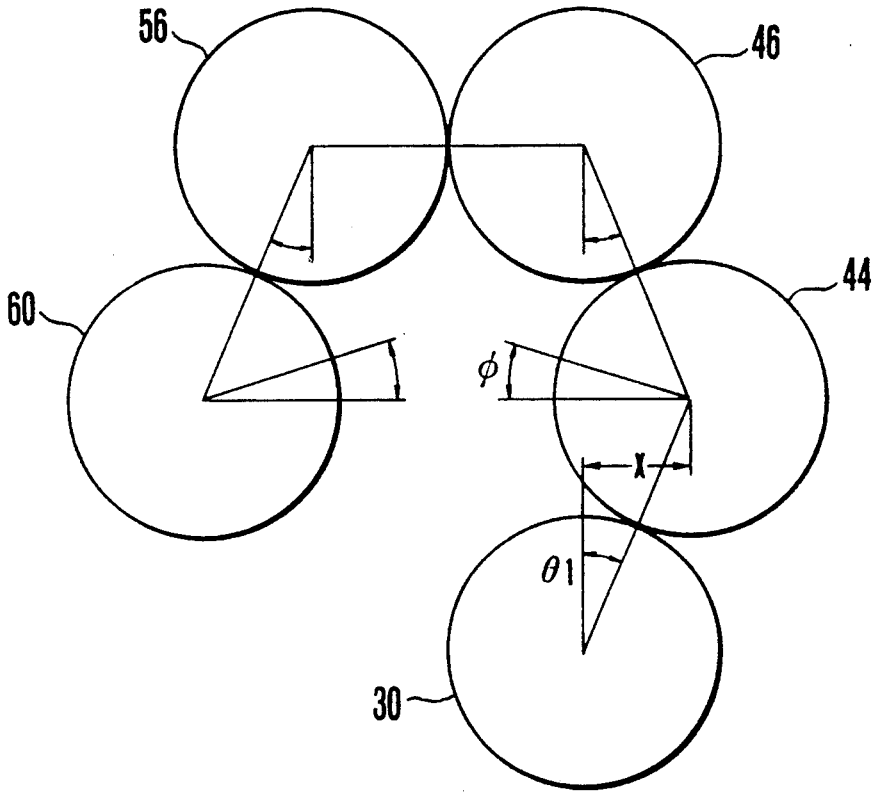
FIG. 15 is a view showing a gear arrangement of the embodiment shown in FIG. 14.
Figure 16:
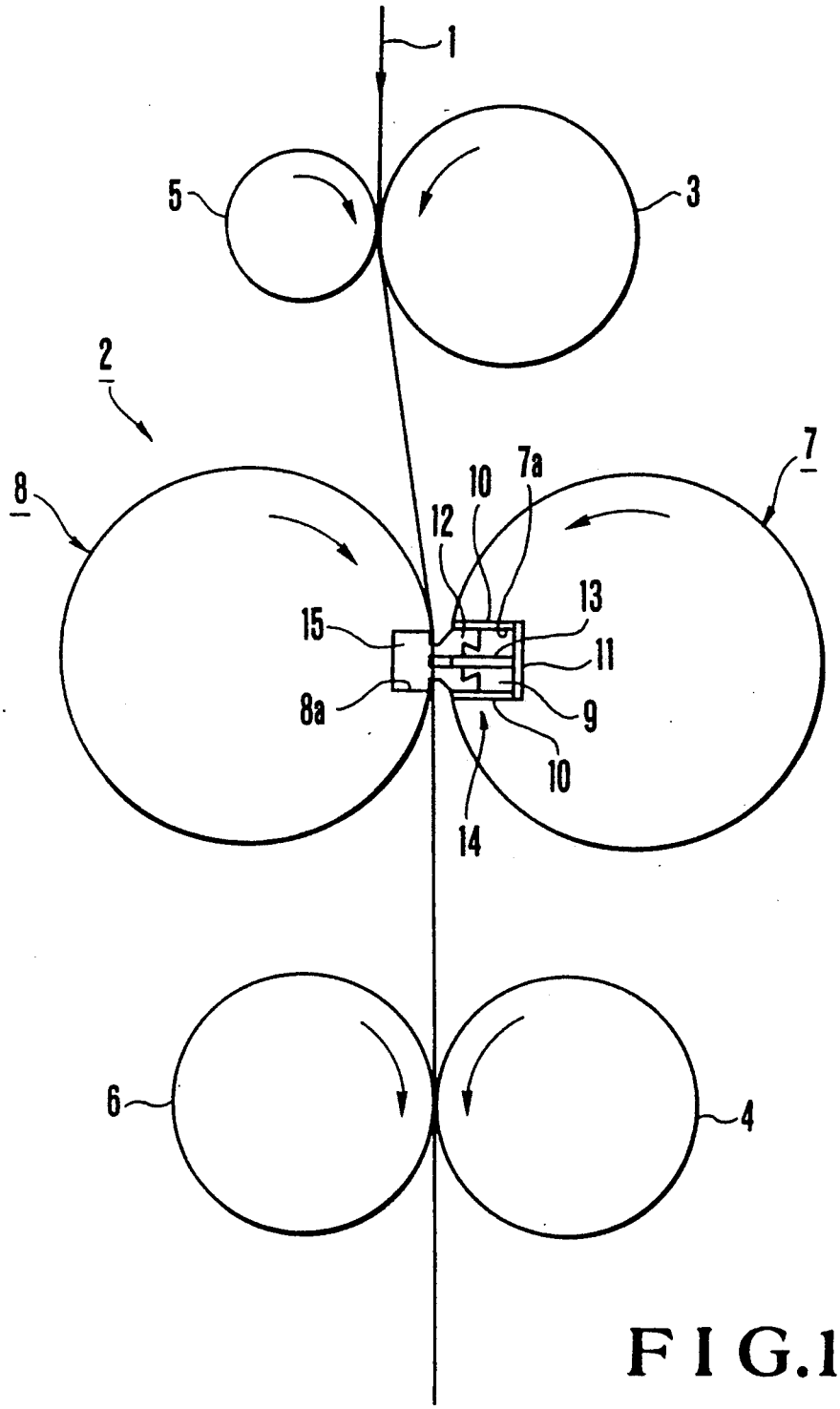
FIG. 16 is a schematic side view of a conventional horizontal perforation forming apparatus for a rotary press.

Referring to FIG. 15, a phase error $\phi$ will be defined as follows:

$$\phi=\theta_1(1+Z_1/Z_2) \quad (1)$$

where $Z_1$ is the number of teeth of a driving gear 30, $Z_2$ is the number of teeth of a perforation cylinder gear 44, and $\theta_1$ is an angle obtained by moving the perforation cylinder.

A moving amount x of the perforation cylinder is defined as follows:

$$x=\{m_n(Z_1+Z_2)2\cos\beta_0\}\tan\theta_1 \quad (2)$$

where $m_n$ is the gear angle module, and $\beta_0$ is a torsion angle. When the angle $\theta_1$ is sufficiently small, the following condition is established:

$$\tan\theta_1 \approx \theta_1 \text{ (rad)}$$

therefore, the phase error can be rewritten as follows:

$$\theta_1=[2x\cos\beta_0/\{m_n(Z_1+Z_2)\}] \quad (3)$$

When a substitution of equation (3) into equation (1) eliminates $\theta_1$ and yields the following equation of the phase error:

$$\phi=\{2\cos\beta_0/m_nZ_2\}x=C_1x \text{ (rad)} \quad (4)$$

$$\text{for } C_1=2\cos\beta_0/m_nZ_2$$

That is, it is apparent that the horizontal perforation phase error $\phi$ caused by the moving amount x of the perforation cylinder is proportional to the moving amount x of the cylinder.

The arrangement of this embodiment will be described with reference to FIG. 14. A phase adjusting shaft 26 is divided into two parts from the center in the axial direction, and clockwise and counterclockwise threaded portions are formed in a split portion and are engaged with a wide gear 120. Reference numeral 122 denotes a guide pin integrally formed with one phase adjusting shaft 26 and slidably fitted in a hole **26*b* formed in the other phase adjusting shaft 26. A gear 123 meshed with the gear 120 is mounted on an operation shaft 75. Reference numeral 74 denotes a bracket for slidably supporting a shaft end portion of the phase adjusting shaft 26. When the operation shaft 75 is pivoted, the phase adjusting shaft 26 whose pivotal movement is restricted by a key 87 is moved upon meshing between the gear 120 and the gear 123. Other arrangements are the same as those of FIG. 2**, and a detailed description thereof will be omitted.

With the above arrangement, when the thickness of a web 1 is changed or the distal end of a perforation blade 68 is worn, a gap between a paper holder 65 and a perforation blade seat 71 must be adjusted. In this case, an operator holds and turns a handle 76 to pivot the operation shaft 75, and a screw shaft 84 is synchronously rotated through meshing between bevel gears 85 and 86. The studs 79 and 82 and stud holders 77 and 80 of a perforation cylinder 42 and its mating cylinder 58 are moved in opposite circumferential directions by the action of counterclockwise and clockwise threaded portions **84*a* and 84*b*. The perforation cylinder 42 and the mating cylinder 58 are pivoted in opposite directions, and a perforation blade case 61 and the perforation blade seat 71 are moved to adjust the gap between the paper holder 65 and the perforation blade seat 71**.

In this apparatus, upon pivotal movement of the operation shaft 75, the phase adjusting shaft 26 whose pivotal movement is restricted by the key 87 is axially moved upon meshing between the gears 120 and 123. The cylinder gear 44 is slightly pivoted through the gear 30 by the action of the helical teeth of a gear 28, so that a phase of the perforation cylinder 42 with respect to a stopped folding cylinder 21 is adjusted.

A phase adjustment amount $\Phi$ of the perforation cylinder given by an axial displacement amount y of the phase adjusting shaft 26 in interaxial distance adjustment and phase adjustment is given as follows:

$$\begin{aligned}\Phi &= (2y/Z_{44})(Z_{28}\sin\beta_i/Z_{27}\cdot m_i+\sin\beta_0/m_0) \\ &= C_2\cdot y \text{ (rad)}\end{aligned} \quad (5)$$

$$\text{for } C_2 = 2/Z_{44}\times(Z_{28}\sin\beta_i/Z_{27}\cdot m_i+\sin\beta_0/m_0) = \text{cos}t$$

where $Z_{24}$, $Z_{27}$, $Z_{28}$, and $Z_{44}$ are numbers of teeth of gears 24 and 27 and the gears 28 and 44, respectively, $m_i$ is the quadrature module of teeth of each of the gears 24 and 27, $m_0$ is the quadrature module of teeth of each of the gears 28 and 44, $\beta_i$ is the torsion angle of each of the gears 24 and 27, and $\beta_0$ is the torsion angle of each of the gears 28 and 44.

In this case, the phase can be changed in proportion to the displacement amount y.

As is apparent from equations (4) and (5), when the perforation cylinder is moved by x (mm), the phase adjusting shaft 26 is moved by $y=(C_1/C_2)x$ (mm), thereby correcting the perforation phase error.

When a handle 89 is pivoted to adjust only the horizontal perforation phase, the divided phase adjusting shafts 26 are simultaneously moved through the gear 120 in the axial direction, so that the phase can also be changed. In this case, since the gear 120 is moved only in the axial direction, axial movement of the gear 120 does not cause circumferential movement of the gear 123.

According to the present invention as has been described above, the interaxial distance adjusting unit for adjusting an interaxial distance between the perforation cylinder and the mating cylinder is included in the horizontal perforation forming apparatus for a rotary press wherein the perforation blade extending in the axial direction of the perforation cylinder of the rotary press is located to oppose the perforation blade seat extending in the axial direction of the mating cylinder upon rotation of the perforation and mating cylinders, and horizontal perforations are formed by the perforation blade in a web which is traveling between the perforation and mating cylinders. At the time of movement of the perforation blade case, e.g., at the time of a change in paper thickness, the perforation blade case need not be removed unlike in the conventional apparatus wherein a shim plate is replaced. After initialization is completed, fine adjustment can be performed at high speed while the operator checks an actual folding operation. Operability can be improved, and the downtime of the press can be greatly reduced. At the same time, waste of paper can be reduced. When printing is changed to printed matters which do not require perforations, the perforation blade case need not be removed unlike in the conventional apparatus. The perforation blade case is moved away from the traveling web while the perforation blade case is kept attached to the press, thus providing a large advantage. In addition, the moving amount of the cylinder is effectively given as an adjustment amount of the extension of the perforation blade.

The horizontal perforation forming apparatus for a rotary press includes the phase adjusting unit for moving the phase adjusting shaft in the axial direction to pivot the perforation cylinder so as to adjust the phase of the perforation cylinder in the circumferential direction. At the same time, the operation shaft of the interaxial distance adjusting unit is interlocked with the phase adjusting shaft, so that the perforation phase will not be deviated from the proper phase while phase adjustment is synchronized with adjustment for a distance between the axes of the perforation cylinder and the mating cylinder. The preparation time can be reduced, productivity can be increased, and the labor can be reduced. At the same time, waste of paper can be reduced.

What is claimed is:

1. A horizontal perforation forming apparatus for a rotary press comprising:

a perforating cylinder having a perforation blade extending substantially parallel to a longitudinal axis of said perforation cylinder;

a mating cylinder mounted adjacent said perforation cylinder, said mating cylinder having a perforation blade seat extending in an axial direction of said mating cylinder, said perforation blade and perforation blade seat being adapted to cooperate with and oppose each other upon rotation of said perforation and mating cylinders;

drive gear means for driving said perforation cylinder, said mating cylinder being directly geared to said perforation cylinder so as to provide proper mating of said perforation blade with said perforation blade seat, said drive gear means having a gear shaft;

interaxial distance adjusting means for adjusting a distance between axes of said perforation and mating cylinders; and eccentric shaft coupling means coupled with said gear shaft and said perforation cylinder, said eccentric shaft coupling means having a first support portion attached to said perforation cylinder, said eccentric shaft coupling means having a second support portion attached to said gear shaft, said second support portion being eccentrically coupled with said first support portion to produce an eccentric action therebetween, said eccentric shaft coupling means allowing said interaxial distance adjusting means to adjust said distance without producing an angular phase shift between said drive gear means and said perforation cylinder, said eccentric shaft coupling means allowing equal adjustment of said distance between axes of said perforation and mating cylinders while enabling said perforation blade and said perforation blade seat to remain substantially opposing.

2. A horizontal perforation forming apparatus for a rotary press comprising:

a perforation cylinder having a perforation blade extending substantially parallel to a longitudinal axis of said perforation cylinder;

a mating cylinder mounted adjacent said perforation cylinder, said mating cylinder having a perforation blade seat extending in an axial direction of said mating cylinder, said perforation blade and perforation blade seat being adapted to cooperate with an oppose each other upon rotation of said perforation and mating cylinders;

drive gear means for driving both said perforation cylinder and mating cylinder, said perforation cylinder and mating cylinder being indirectly geared together so as to provide proper mating of said perforation blade with said perforation blade seat;

interaxial distance adjusting means for adjusting a distance between axes of said perforation and mating cylinders, said interaxial distance adjusting means having first eccentric bearing means rotatably supporting said perforation cylinder and second eccentric bearing means rotatably supporting said mating cylinder, said interaxial distance adjusting means rotating said first and second eccentric bearing means to provide substantially equal adjustment of both said perforation and mating cylinders, said equal adjustment enabling said perforation blade and said perforation blade seat to remain opposing; and phase adjusting means having a phase adjusting shaft which is axially moved to rotate said perforation cylinder, said perforation cylinder thereby rotating said mating cylinder by said perforation cylinder being indirectly geared with said mating cylinder, said phase adjusting means correcting a phase error created upon said equal adjustment of said distance between axes of said perforation and mating cylinders so as to enable horizontal perforations to be properly located on a web.

3. An apparatus according to claim 2, wherein said interaxial distance adjusting means further comprises:

an operation shaft;

a handle secured to said operation shaft;

first bevel gears mounted on said operation shaft;

second bevel gears meshed with said first bevel gears, respectively; and cylinder moving means associated with said second bevel gears for rotating said first and second eccentric bearing means.

4. An apparatus according to claim 3, wherein said first eccentric bearing means is a pair of right eccentric bearings and said second eccentric bearing means is a pair of left eccentric bearings and wherein said cylinder moving means further comprises:

stud holders respectively fixed to said pair of right eccentric bearings and said pair of left eccentric bearings;

studs respectively fixed in said stud holders; and counterclockwise and clockwise screws threadably engaged and reciprocated in screw holes of said studs, respectively.

5. An apparatus according to claim 3, wherein said cylinder moving means comprises:

at least one pair of levers coupled to at least said perforation cylinder;

shafts to which said second bevel gears are mounted;

worm wheels formed on said at lest one pair of levers; and worm gears meshed with said worm wheels, respectively.

6. An apparatus according to claim 3, wherein said cylinder moving means comprises:

a pair of right and left levers coupled to said perforation cylinders;

right and left shafts to which said second bevel gears are mounted;

worm wheels respectively formed on said right and left levers; and worm gears meshed with said worm wheels, respectively.

7. An apparatus according to claim 2, wherein said phase adjusting shaft comprises a single shaft.

8. A horizontal perforation forming apparatus for a rotary press comprising:

a perforation cylinder having a perforation blade extending substantially parallel to a longitudinal axis of said perforation cylinder;

a mating cylinder mounted adjacent said perforation cylinder, said mating cylinder having a perforation blade seat extending in an axial direction of said mating cylinder, said perforation blade and perforation blade seat being adapted to cooperate with and oppose each other upon rotation of said perforation and mating cylinders;

drive gear means for driving both said perforation cylinder and mating cylinder, said perforation cylinder and mating cylinder being indirectly geared together so as to provide proper mating of said perforation blade with said perforation blade seat;

interaxial distance adjusting means having operation shaft for adjusting a distance between axes of said perforation and mating cylinders, said interaxial distance adjusting means providing substantially equal adjustment of both said perforation and mating cylinders, said equal adjustment enabling said perforation blade and said perforation blade seat to remain opposing; and phase adjusting means for correcting a phase error created upon said equal adjustment of said distance between axes of said perforation and mating cylinder, said phase adjusting means engaging said interaxial distance adjusting means so as to be operated thereby, said phase adjusting means enabling horizontal perforations to be properly located on a web.

9. An apparatus according to claim 8, wherein said phase adjusting means comprises a phase adjusting shaft which is axially moved to rotate said perforation cylinder, said perforation cylinder thereby rotating said mating cylinder by said perforation cylinder being indirectly geared with mating cylinder, said phase adjusting shaft being engaged with said operation shaft such that said phase adjusting shaft is moved axially upon rotation of said operation shaft.

10. An apparatus according to claim 9, wherein said phase adjusting shaft is constituted by two divided phase adjusting shafts coupled through a guide pin, said two divided phase adjusting shafts being provided with counterclockwise and clockwise threaded portions at mating end portions thereof, said counterclockwise and clockwise threaded portions being meshed with a wide gear which is further meshed with a gear mounted on said operation shaft.

* * * * *

UNITED STATES PATENT AND TRADEMARK OFFICE

CERTIFICATE OF CORRECTION

PATENT NO. : 5,048,387

DATED : 09/17/91

INVENTOR(S) : Tsutomu Niitsuma et al

It is certified that error appears in the above-identified patent and that said Letters Patent is hereby corrected as shown below:

Column 3, line 27, delete "if" and insert ---- of ----.

Column 4, line 41, delete "about" and insert ---- abut ----.

Column 7, line 3, delete "eft" and insert ---- left ----.

Column 7, line 16, delete "hole".

Column 7, line 42, after "cylinder" insert ---- 58 ----.

Column 9, line 1, delete "perforamtion" and insert ---- perforation ----.

Column 9, line 6, delete "changes" and insert ---- changed ----.

Column 11, line 60, delete ")2" and insert ---- )/2 ----.

Column 15, line 40, delete "lest" and insert ---- least ----.

Column 15, line 47, delete "cylinders" and insert ---- cylinder ----.

UNITED STATES PATENT AND TRADEMARK OFFICE

CERTIFICATE OF CORRECTION

PATENT NO. : 5,048,387

DATED : 09/17/91

INVENTOR(S) : Tsutomu Niitsuma et al

It is certified that error appears in the above-identified patent and that said Letters Patent is hereby corrected as shown below:

Column 16, line 20, after "having" insert ---- an ----.

Column 16, line 31, delete "der" and insert ---- ders----.

Column 16, line 41, after "with" insert ---- said ----.

Signed and Sealed this

Twelfth Day of January, 1993

*Attest:*

*Attesting Officer*

DOUGLAS B. COMER

*Acting Commissioner of Patents and Trademarks*